US009353508B2

(12) United States Patent
Abello Jimenez

(10) Patent No.: US 9,353,508 B2
(45) Date of Patent: May 31, 2016

(54) FAUCET-DOOR FOR A SINK OR COUNTERTOP

(76) Inventor: Juan Antonio Abello Jimenez, Cartana Estacion (ES)

( * ) Notice: Subject to any disclaimer, the term of this patent is extended or adjusted under 35 U.S.C. 154(b) by 181 days.

(21) Appl. No.: 14/232,815

(22) PCT Filed: Jul. 4, 2012

(86) PCT No.: PCT/ES2012/070492
§ 371 (c)(1),
(2), (4) Date: Jan. 14, 2014

(87) PCT Pub. No.: WO2013/011177
PCT Pub. Date: Jan. 24, 2013

(65) Prior Publication Data

US 2014/0165286 A1 Jun. 19, 2014

(30) Foreign Application Priority Data

Jul. 15, 2011 (ES) ..... 201130765 U
May 17, 2012 (ES) ..... 201230534 U

(51) Int. Cl.
*A47J 47/20* (2006.01)
*A47L 19/02* (2006.01)
*A47L 19/04* (2006.01)
*E03C 1/04* (2006.01)
*A47B 77/06* (2006.01)

(52) U.S. Cl.
CPC ..... *E03C 1/0404* (2013.01); *A47B 77/06* (2013.01); *E03C 2001/0417* (2013.01)

(58) Field of Classification Search
CPC ..... E03C 1/0404; E03C 2001/0417; E03C 1/186; E03C 1/042; A47B 77/06; A47B 46/00
See application file for complete search history.

(56) References Cited

U.S. PATENT DOCUMENTS 261,021 A * 7/1882 Miller ..... F61K 1/20 251/303
616,106 A * 12/1898 Houston ..... 4/626
2,594,938 A * 4/1952 Leavitt ..... E03C 1/18 4/626
3,469,603 A * 9/1969 Nagel ..... E03C 1/0404 137/599.08

(Continued)

FOREIGN PATENT DOCUMENTS

JP 05148871 A * 6/1993
JP 2002194788 A * 7/2002

OTHER PUBLICATIONS

JP 05148871—English Translation; machine generated, Sep. 2015.*

(Continued)

*Primary Examiner* — J. Casimer Jacyna
*Assistant Examiner* — Benjamin R Shaw
(74) *Attorney, Agent, or Firm* — Lucas & Mercanti, LLP

(57) ABSTRACT

The present invention relates to a faucet-door for coupling to kitchen sinks or countertops primarily, although it can also be coupled to bathroom sinks, basins, etc. The object of the invention consists of combining a faucet and a door in a single element, with the particularity that the pivot shafts of the faucet-door are hollow, defining the hot water connection and cold water connection, faucet-door in the central core of which ducts are defined for hot water and cold water passage which open into a main casing established on the inner face of said central core, being of little thickness, for being re-conducted towards a diffuser that can be folded away on said casing, the ducts being associated with the corresponding flow rate-regulating means.

4 Claims, 3 Drawing Sheets

(56) References Cited

U.S. PATENT DOCUMENTS

| | | | | |
|---|---|---|---|---|
| 5,301,376 | A * | 4/1994 | Herbert | A47K 1/02 220/379 |
| 5,702,115 | A | 12/1997 | Pool | |
| 5,778,273 | A * | 7/1998 | Ben-Yaacov | G03D 17/00 396/589 |
| 6,427,259 | B1 * | 8/2002 | Cawthon | A22C 25/025 4/619 |
| 2002/0184704 | A1 * | 12/2002 | Cawthon | A22C 25/025 4/619 |
| 2003/0088913 | A1 * | 5/2003 | Underbrink | A47K 1/02 4/619 |
| 2005/0055766 | A1 * | 3/2005 | Warning | B60R 15/02 4/619 |
| 2005/0178452 | A1 * | 8/2005 | Vilhelmsen | E03C 1/0404 137/801 |
| 2007/0157378 | A1 * | 7/2007 | Kendall | A47B 67/04 4/630 |
| 2007/0186341 | A1 * | 8/2007 | Uffner | A47K 1/02 4/619 |

OTHER PUBLICATIONS

JP 2002194788—English Translation; machine generated, Sep. 2015.*

* cited by examiner

FAUCET-DOOR FOR A SINK OR COUNTERTOP

CROSS-REFERENCE TO RELATED APPLICATIONS

This application is a 371 of PCT/ES2012/070492 filed Jul. 4, 2012, which in turn claims the priority of ES U201130765 filed Jul. 15, 2011 and ES U201230534 filed May 17, 2012, the priority of these applications is hereby claimed and these applications are incorporated by reference herein.

OBJECT OF THE INVENTION

The present invention relates to a faucet-door for coupling to kitchen sinks or countertops primarily, although it can also be coupled to bathroom sinks, basins, etc . . . , even bathtubs and spas (when manufactured in a larger size). It can be said that said invention is the consequence of combining a faucet and a door, resulting in a novel object that joins the features of both, having a single volume for using what required two volumes (a faucet plus a door) prior to the invention.

The object of the invention is to achieve an optimal appearance for a kitchen countertop, increasing the functionality thereof by providing more work space, establishing surface continuity between the faucet-door (closing the cavity of the sink when it is not being used) and the countertop. It does so with a modern structure which, in the inoperative position, has a minimum volume, likewise offering other functions, such as the inclusion of a soap dispenser, and operating controls by means of tactile sensors.

BACKGROUND OF THE INVENTION

A plurality of appliances, such as a microwave, coffee maker, etc., is integrated in kitchen furniture today, such that the integration of those appliances in the furniture forms very aesthetically pleasing combinations. Nevertheless, since the sink defines a cavity in the countertop surface, it breaks the appearance of said surface, regardless of the type of kitchen furniture.

Said hollow of the sink is sometimes covered with a lid, the main purpose of which is to hide certain objects and/or dishes that were used beforehand in the sink, but the faucet or faucets and the control or controls thereof are always exposed, it sometimes even being impossible to place or have a lid because the faucet position or mounting does not allow it.

In the attempt to overcome these drawbacks, faucets provided with pivoting means for pivoting towards the inside of the sink in the inoperative position are known.

The problem with such devices is that they consist of large elements which considerably enter the sink in the inoperative position, so said sink must be empty or minimal space must be taken up so that the faucet can be folded away in the sink, which is not always possible, for example in the event of an unexpected visit. Furthermore, such devices are not harmoniously integrated with the countertop in the inoperative position.

DESCRIPTION OF THE INVENTION

The proposed faucet-door has been designed to solve the drawbacks described above based on a simple but effective solution, because the sink is hidden by said faucet-door that can be folded away and hinged by any suitable system to one of the edges bordering the sink or the countertop, such that when the sink is not being used, the faucet-door folds away and covers the cavity of the countertop, hiding the sink, the faucet-door forming surface continuity with the countertop itself, the sink being hidden regardless of whether there are objects such as plates and the like in the sink.

More specifically, the faucet-door for hiding the sink mounted such that it can be folded away based on suitable hinging, has the particularity of being formed using a water-resistant material or a rust-resistant material, its upper and lower faces being covered with a surface trim of the color and/or material of the countertop or a similar appearance, being able to include a open/close frame.

According to another feature of the invention, it has been envisaged that the hinge shafts of the door are hollow, such that they define cold water inlet connection and the hot water inlet connection and passages, said faucet-door internally having internal ducts through which the water and dishwashing soap is conducted. These elements will circulate through these ducts, and before passing through the open/close valves they open into the dispensers, which are such that they can be folded away onto the body of the faucet-door.

In other words, the door thus formed and mounted can incorporate on its inner or internal face one or several faucets and water supply system, either faucets, a combination of valves, shut-off valves and other parts for the desired supply, i.e., all those components are integrated in the lower face of the door that can be folded away, such that the faucets and their controls are such that they can be folded away when closing said door, being able to close the door even in the event that there are dishes or other objects to be washed inside the sink.

The manual operating controls can also be folded away, acting on the corresponding valves which close/open the cold water/hot water conduits.

Said valves could optionally be replaced with electrovalves, such that the opening/closing thereof is controlled by tactile sensors that will be arranged on a casing protruding minimally with respect to the inner face of the faucet-door.

According to another option offered by the faucet-door, the latter can add more than one dispenser or diffuser with its respective, also fold-away, controls, such that a second dispenser associated with a soap reservoir is established, said reservoir being integrated in the faucet-door itself, accessible through the edge thereof, or in an independent pumping element established under the countertop. A third dispenser for potable water coming from reverse osmosis equipment or the like can optionally be established in the body of the faucet-door.

The operation of the faucet-door for opening and closing it can be done manually, being kept in a vertical position by the action of a spring or pneumatic piston. It will also remain in the closed position by means of the action of a pneumatic piston or system of springs which tends to permanently move it towards the closed position after manual operation. It can also be operated with motor-powered means.

DESCRIPTION OF THE DRAWINGS

To complement the description that will be provided below and for the purpose of aiding to better understand the features of the invention according to a preferred practical embodiment thereof a set of drawings is attached as an integral part of said description, in which the following has been depicted with an illustrative and non-limiting character.

PREFERRED EMBODIMENT OF THE INVENTION

Figure 1:
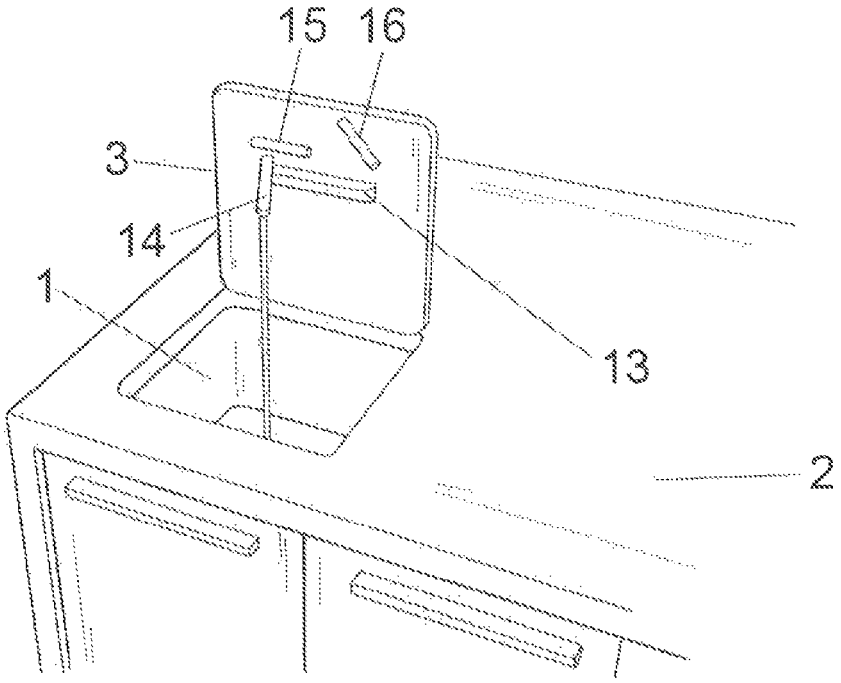
FIG. 1 shows a perspective view of a countertop which is equipped with a faucet-door formed according to the object of the present invention.
Figure 2:
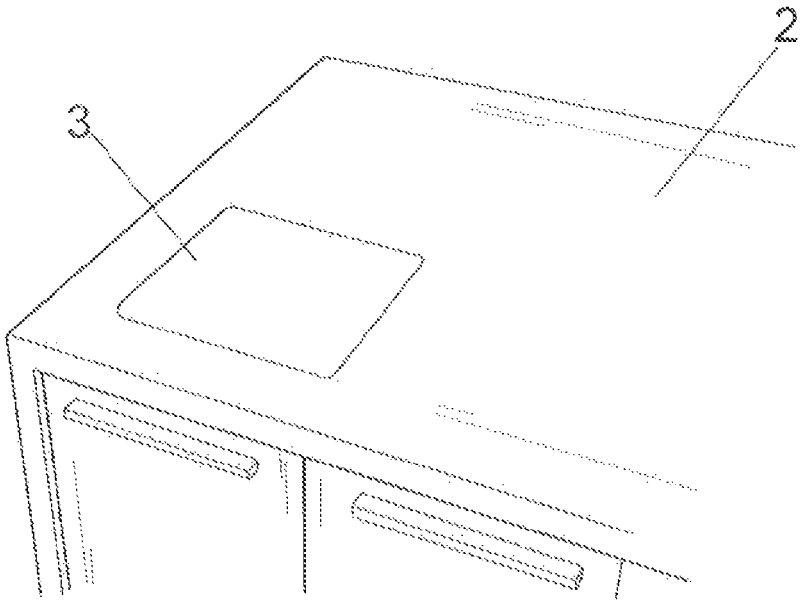
FIG. 2 shows a view similar to that of FIG. 1, but in which the faucet-door is seen in the inoperative and concealed position, showing a detail of a recess for manually opening it.
Figure 3:
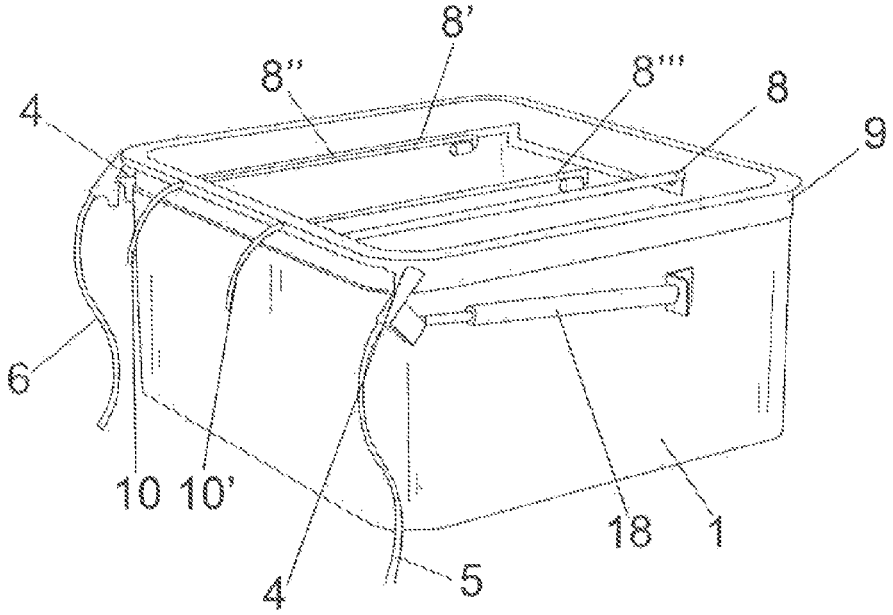
FIG. 3 shows a perspective detail view of the assembly with the hydraulic opening means provided for the movement thereof, in which the faucet-door is shown to be diaphanous to allow seeing the ducts arranged therein.

In view of the mentioned figures, it can be seen how a sink (1) integrated in a countertop (2) is perfectly hidden when a faucet-door (3), which is the object resulting from combining a faucet and a door, which is the purpose of the present invention, is coupled to the sink or to the countertop, where the body of the faucet is the door, inside which the elements to be supplied, either water, soap, etc . . . , circulate, and where the valves and other operating elements for the desired operation are also mounted, as shown in FIG. 2 in the inoperative position, the hinge shafts (4) of which are hollow and coincide with respective hot water connection (5) and cold water connection (6), as can be seen in FIG. 3.

In addition to being made from rust-resistant material, this faucet door (3) will be formed as or covered with a surface that is the same as that of the countertop (2) itself so that when the faucet door (3) is in the closed position it establishes surface continuity, or in other words a homogenous appearance, throughout the entire countertop (2), completely hiding the cavity of the sink (1).

Figure 8:
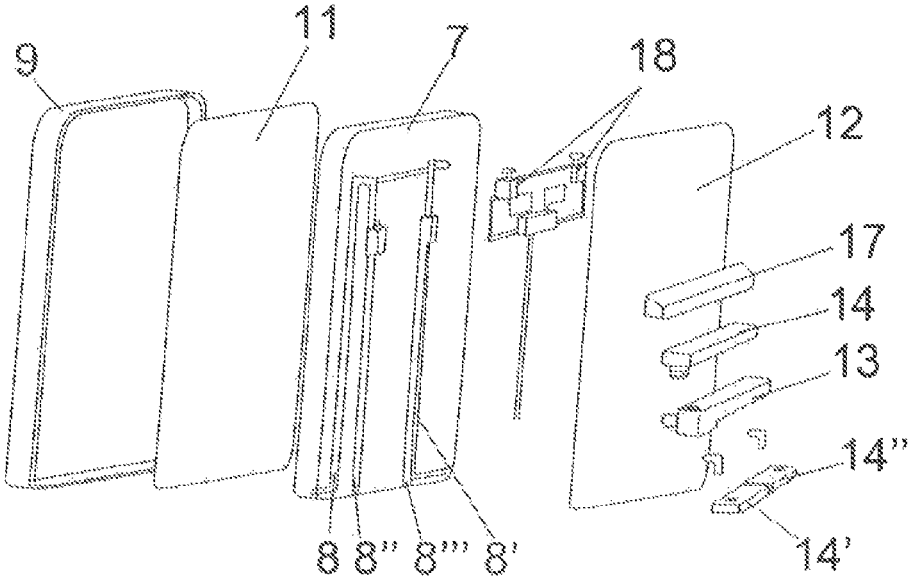
FIG. 8 ultimately shows an exploded view of a faucet-door.

More specifically, and according to FIGS. 3 and 8, the faucet-door (3) will preferably be defined by a central core (7) provided with internal ducts (8-8'), either recesses or pipes, which are communicated with the hot water connection (5) and cold water connection (6), as well as optionally another series of ducts (8" and 8"') intended for the dishwashing soap duct or the duct for other products, such as potable water, which are connected through the frame (9) of the door to the complementary product connections (10-10').

The faucet-door (7) and frame (9) are complemented with a respective outer trim part (11) and a respective inner trim part (12), the outer one preferably having the same finish as the countertop (2).

Figure 4:
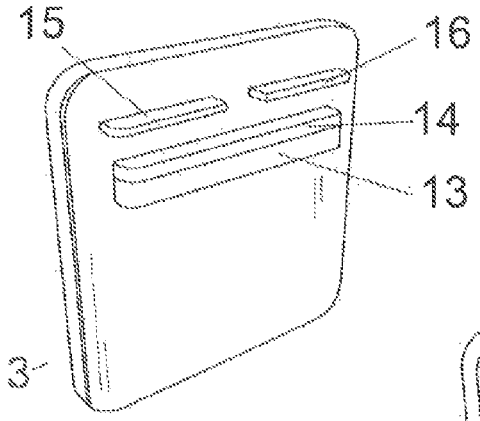
FIG. 4 shows a perspective view of the faucet-door object of the invention according to its inner face, in a folded arrangement for its dispensers and controls, and according to the simplest version of the invention, in which there is a single dispenser.
Figure 5:
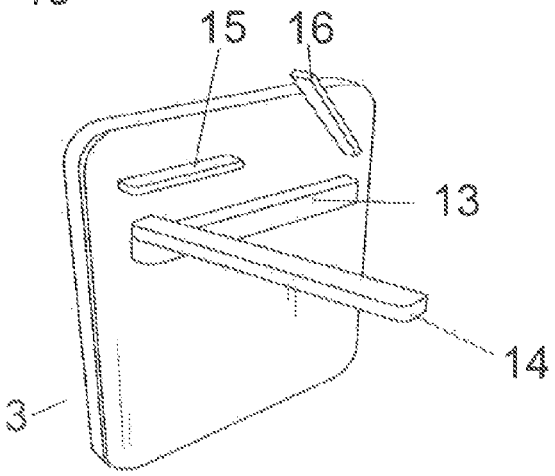
FIG. 5 shows a view similar to that of the preceding figure, but corresponding to the faucet-door in the operative position.

An elongated trim casing (13), being of little thickness, is arranged in the upper middle area of the inner face of the faucet-door, on which casing (13) the water diffuser (14) can be folded away, which water diffuser (14) in a first practical embodiment variant of the invention shown in FIGS. 4 and 5 is controlled by means of a pair of manual operating controls (15-16), operated by means of pivoting same, all such that in the inoperative position shown in FIG. 4, the assembly takes up minimal space, allowing the closure of the door on the sink (1) per se, even though said sink (1) is partially occupied by dishes and/or glasses.

Therefore, when the sink (1) is not being used, even being able to contain objects or dishes therein, it can be hidden by means of folding away the door towards the closed position because the outer surface thereof is made of the same material or a material that is similar to that of the countertop (2) to establish surface continuity, or in other words, a homogenous appearance with respect to said countertop (2), the door (3) being able to be operated to open or close it manually or automatically, i.e., by means of a hydraulic piston, gas, in a motor-powered manner, etc.

Figure 6:
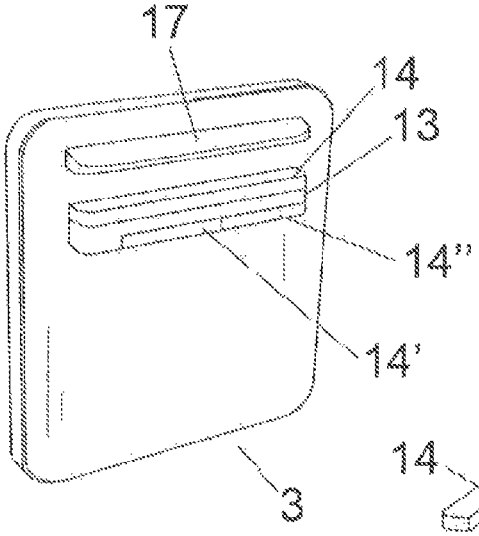
FIG. 6 shows a perspective view similar to that of FIG. 5, but corresponding to a more complex embodiment variant in which there are three dispensers and the operation thereof is by means of tactile sensors.
Figure 7:
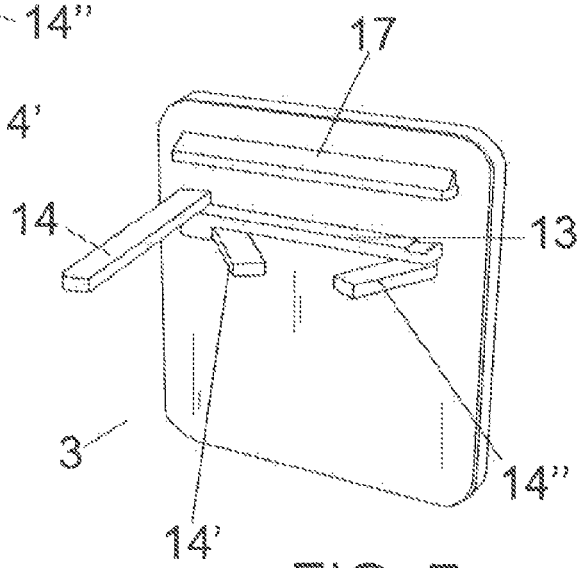
FIG. 7 shows a view similar to that of FIG. 6, but in a position in which its dispensers are being used.

In a second embodiment variant such as that shown in FIGS. 6 and 7, the manual controls (15-16) can be replaced with a tactile sensor (17) which, through a central installation, acts on electrovalves (18) associated with the different internal ducts (8-8'-8" and 8").

As previously mentioned, the faucet-door (3) could optionally incorporate more than one dispenser or diffuser, for example those (14', 14") shown in the drawings having a smaller size, likewise associated with the casing (13) and such that they can be folded away taking up minimal space in the inoperative position, such that said diffusers or dispensers could be used for dispensing cleaning soap or other products, likewise controlled by the tactile sensor (17), or their complementary controls could be arranged.

Nevertheless, and in the event that these dispensers are intended for dispensing cleaning soap or the like, a reservoir containing the product to be metered, accessible through the corresponding cap arranged on the frame of the door or on the casing (13) itself, could be defined in the casing (13) itself or in the core (7) of the faucet-door (3), in a suitable place located above said faucets.

Concerning the means for operating the faucet-door (3), such means can be formed as hydraulic cylinders (18) or springs, as shown in FIGS. 3 and 4, being able to have locking devices for locking it in one and/or another end position.

The invention claimed is:

1. A faucet-door for a sink or countertop for mounting in basins, bathroom sinks, bathtubs, and spas, having valves and controls for regulating the cold water and hot water flow rate, as well as the corresponding water supply pipes or conduits, comprising a faucet and a door combined in a single element, where the body of the faucet is the door, pivot shafts of the faucet-door are hollow, defining the hot water connection and cold water connection, the faucet-door having a central core with ducts for hot water and cold water passage, said ducts opening into a main casing established on the inner face of said central core, the main casing connected to a diffuser that can be folded away on said casing, the ducts being associated with corresponding flow rate-regulating means, wherein the flow rate-regulating means are formed by respective manual controls established on the inner face of the faucet door, coupled to their corresponding valves which are mounted in the body of the faucet-door.

2. A faucet-door for a sink or countertop for mounting in basins, bathroom sinks, bathtubs, and spas, having valves and controls for regulating the cold water and hot water flow rate, as well as the corresponding water supply pipes or conduits, comprising a faucet and a door combined in a single element, where the body of the faucet is the door, pivot shafts of the faucet-door are hollow, defining the hot water connection and cold water connection, the faucet-door having a central core with ducts for hot water and cold water passage, said ducts opening into a main casing established on the inner face of said central core, the main casing connected to a diffuser that can be folded away on said casing, the ducts being associated with corresponding flow rate-regulating means, wherein the flow rate-regulating means are formed by a tactile sensor established on the inner face of the door and associated with corresponding flow rate-regulating electrovalves.

3. A faucet-door for a sink or countertop for mounting in basins, bathroom sinks, bathtubs, and spas, having valves and controls for regulating the cold water and hot water flow rate, as well as the corresponding water supply pipes or conduits, comprising a faucet and a door combined in a single element, where the body of the faucet is the door, pivot shafts of the faucet-door are hollow, defining the hot water connection and cold water connection, the faucet-door having a central core with ducts for hot water and cold water passage, said ducts opening into a main casing established on the inner face of said central core, the main casing connected to a diffuser that can be folded away on said casing, the ducts being associated with corresponding flow rate-regulating means, wherein additional ducts are defined in the core of the faucet-door for supplying cleaning soap or other products through additional dispensers or diffusers that can be folded away on the casing associated therewith.

4. A faucet-door for a sink or countertop for mounting in basins, bathroom sinks, bathtubs, and spas, having valves and controls for regulating the cold water and hot water flow rate, as well as the corresponding water supply pipes or conduits, comprising a faucet and a door combined in a single element, where the body of the faucet is the door, pivot shafts of the faucet-door are hollow, defining the hot water connection and cold water connection, the faucet-door having a central core with ducts for hot water and cold water passage, said ducts opening into a main casing established on the inner face of said central core, the main casing connected to a diffuser that can be folded away on said casing, the ducts being associated with corresponding flow rate-regulating means, wherein the faucet-door further comprises one of a pneumatic piston and a set of springs, which tends to permanently move the faucet-door towards a selected position when the faucet-door is operated by manually pulling on the faucet-door.

* * * * *